US006159105A

United States Patent [19]

Henry

[11] Patent Number: 6,159,105

[45] Date of Patent: Dec. 12, 2000

[54] GOLF BALL TEEING APPARATUS

[76] Inventor: Jack Rex Henry, 26635 Del Rosa Dr., Hemet, Calif. 92544

[21] Appl. No.: 09/263,274

[22] Filed: Mar. 5, 1999

[51] Int. Cl.[7] ..... A63B 57/00

[52] U.S. Cl. ..... 473/132

[58] Field of Search ..... 473/132, 134, 473/136, 137

[56] References Cited

U.S. PATENT DOCUMENTS

| | | | |
|---|---|---|---|
| 2,285,342 | 6/1942 | MacLellan | 473/137 |
| 4,141,558 | 2/1979 | Hoffman | 473/132 |
| 5,326,107 | 7/1994 | Park | 473/132 |
| 5,458,339 | 10/1995 | Wildes | 473/137 |
| 5,549,299 | 8/1996 | Brown | 473/133 |
| 5,647,805 | 7/1997 | Tarbox, Jr. | 473/137 |
| 5,707,303 | 1/1998 | Berkowitz | 473/386 |
| 5,718,638 | 2/1998 | Kameda | 473/134 |
| 5,897,325 | 4/1999 | Tomey | 473/134 |

*Primary Examiner*—Steven Wong
*Attorney, Agent, or Firm*—Goldstein & Canino

[57] ABSTRACT

A golf ball teeing apparatus including a housing having a generally rectangular configuration. The housing is defined by a top wall, a bottom wall, opposed long side walls, and opposed short end walls. The top wall has an opening therethrough exposing a hollow interior of the housing. The bottom wall has a peripheral flange secured thereto. The housing has an outlet through a corner formed by one of the opposed long side walls and an adjacent end wall. A tubular golf ball casing is disposed within the hollow interior of the housing for receiving a plurality of golf balls therein. The golf ball casing has a serpentine configuration defined by an open upper end disposed within the opening in the top wall of the housing. The golf ball casing has an open lower end disposed adjacent the outlet of the housing. A slide assembly is slidably disposed within the hollow interior of the housing below the open lower end of the golf ball casing whereby the slide assembly transports the golf balls outwardly of the outlet of the housing.

5 Claims, 2 Drawing Sheets

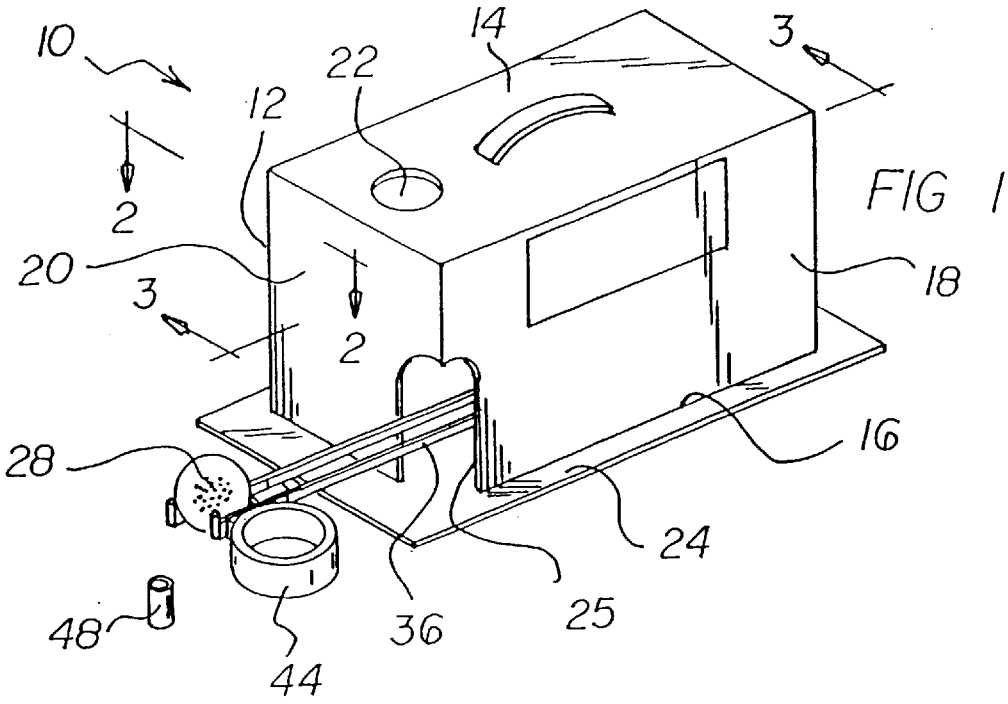
FIG 1
FIG 2
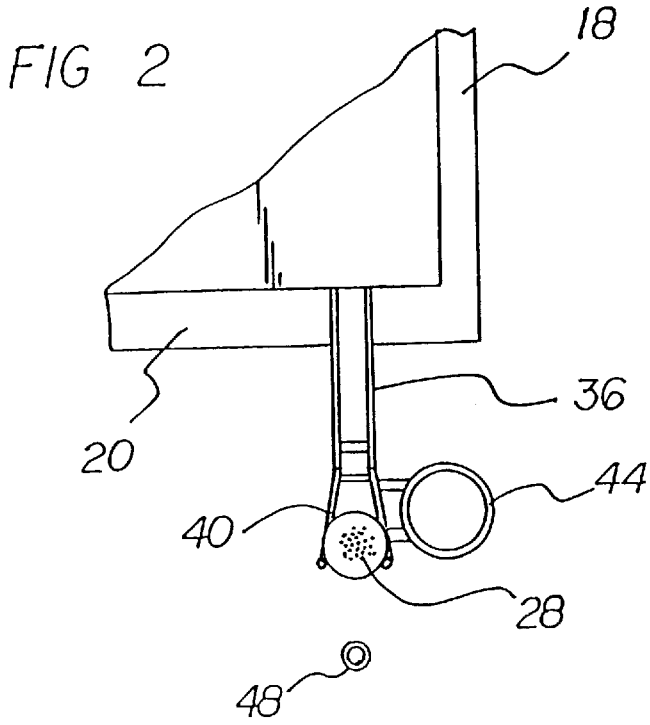

GOLF BALL TEEING APPARATUS

BACKGROUND OF THE INVENTION

The present invention relates to a golf ball teeing apparatus and more particularly pertains to placing a golf ball on a tee without requiring bending over by a golfer.

Since those who want to play the game of golf well must invest substantial time of practice. Driving ranges and other practice facilities have been established so that golfers can practice their shots with a plurality of range balls without having to retrieve any of the balls. Typically, the golfer is provided with a bucket that is filled with balls. The golfer is generally required to bend over after each shot and replace a ball on a tee or other desired location. The golfer who practices for long periods of time can suffer back fatigue from this constant bending. Additionally, golfer's who have back problems to begin with, are limited in the amount of practice time they are allowed before their pain becomes unbearable. The present invention seeks to provide a device that will place a golf ball on a tee without requiring the golfer to bend over to do so.

The use of golfing accessories is known in the prior art. More specifically, golfing accessories heretofore devised and utilized for the purpose of enhancing a person's ability to play golf are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,718,638 to Kameda discloses an automatic golf teeing device with a drive mechanism incorporated for pushing the ball into position. U.S. Pat. No. 5,549,299 to Brown discloses an automatic device for positioning a golf ball onto a tee by use of a vacuum system. U.S. Pat. No. 5,707,303 to Berkowitz discloses a cane-like device for retrieving golf balls.

While these devices fulfill their respective, particular objective and requirements, the aforementioned patents do not describe a golf ball teeing apparatus for placing a golf ball on a tee without requiring bending over by a golfer.

In this respect, the golf ball teeing apparatus according to the present invention substantially departs from the conventional concepts and designs of the prior art, and in doing so provides an apparatus primarily developed for the purpose of placing a golf ball on a tee without requiring bending over by a golfer.

Therefore, it can be appreciated that there exists a continuing need for new and improved golf ball teeing apparatus which can be used for placing a golf ball on a tee without requiring bending over by a golfer. In this regard, the present invention substantially fulfills this need.

SUMMARY OF THE INVENTION

In the view of the foregoing disadvantages inherent in the known types of golfing accessories now present in the prior art, the present invention provides an improved golf ball teeing apparatus. As such, the general purpose of the present invention, which will be described subsequently in greater detail, is to provide a new and improved golf ball teeing apparatus and method which has all the advantages of the prior art and none of the disadvantages.

To attain this, the present invention essentially comprises a housing having a generally rectangular configuration. The housing is defined by a top wall, a bottom wall, opposed long side walls, and opposed short end walls. The top wall has an opening therethrough exposing a hollow interior of the housing. The bottom wall has a peripheral flange secured thereto. The housing has an outlet through a corner formed by one of the opposed long side walls and an adjacent end wall. A tubular golf ball casing is disposed within the hollow interior of the housing for receiving a plurality of golf balls therein. The golf ball casing has a serpentine configuration defined by an open upper end disposed within the opening in the top wall of the housing. The golf ball casing has an open lower end disposed adjacent the outlet of the housing. A slide assembly is slidably disposed within the hollow interior of the housing. The slide assembly includes a pair of sliding tracks disposed below the open lower end of the golf ball casing. The pair of tracks are dimensioned for receiving a golf ball therebetween. The pair of tracks are positioned between upper and lower sets of rollers to facilitate sliding of the pair of tracks outwardly of the outlet of the housing. The pair of tracks include an outer section hingedly secured to outer ends thereof. A pair of springs extend between the outer section and the pair of tracks whereby the springs bias the outer section into a collinear relationship with the pair of tracks. A circular member is secured to an outer surface of the outer section of the pair of tracks of the slide assembly. The circular member is dimensioned for receiving a head of a golf club therein to facilitate pivoting of the outer section with respect to the pair of tracks. A tee is positioned adjacent to the outer section of the pair of tracks of the slide assembly when the pair of tracks are fully extended outwardly of the housing. The tee receives a golf ball thereon.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved golf ball teeing apparatus which has all the advantages of the prior art golfing accessories and none of the disadvantages.

It is another object of the present invention to provide a new and improved golf ball teeing apparatus which may be easily and efficiently manufactured and marketed.

It is a further object of the present invention to provide a new and improved golf ball teeing apparatus which is of durable and reliable construction.

An even further object of the present invention is to provide a new and improved golf ball teeing apparatus which is susceptible of a low cost of manufacture with regard to both materials and labor, and which accordingly is then susceptible of low prices of sale to the consuming public, thereby making such a golf ball teeing apparatus economically available to the buying public.

Even still another object of the present invention is to provide a new and improved golf ball teeing apparatus for placing a golf ball on a tee without requiring bending over by a golfer.

Lastly, it is an object of the present invention to provide a new and improved golf ball teeing apparatus including a housing having a generally rectangular configuration. The housing is defined by a top wall, a bottom wall, opposed long side walls, and opposed short end walls. The top wall has an opening therethrough exposing a hollow interior of the housing. The bottom wall has a peripheral flange secured thereto. The housing has an outlet through a corner formed by one of the opposed long side walls and an adjacent end wall. A tubular golf ball casing is disposed within the hollow interior of the housing for receiving a plurality of golf balls therein. The golf ball casing has a serpentine configuration defined by an open upper end disposed within the opening in the top wall of the housing. The golf ball casing has an open lower end disposed adjacent the outlet of the housing. A slide assembly is slidably disposed within the hollow interior of the housing below the open lower end of the golf ball casing whereby the slide assembly transports the golf balls outwardly of the outlet of the housing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the golf ball teeing apparatus constructed in accordance with the principles of the present invention.

FIG. 2 is a top plan view of the present invention as taken along line 2—2 of FIG. 1.

The same reference numerals refer to the same parts through the various figures.

DESCRIPTION OF THE PREFERRED EMBODIMENT

Figure 3:
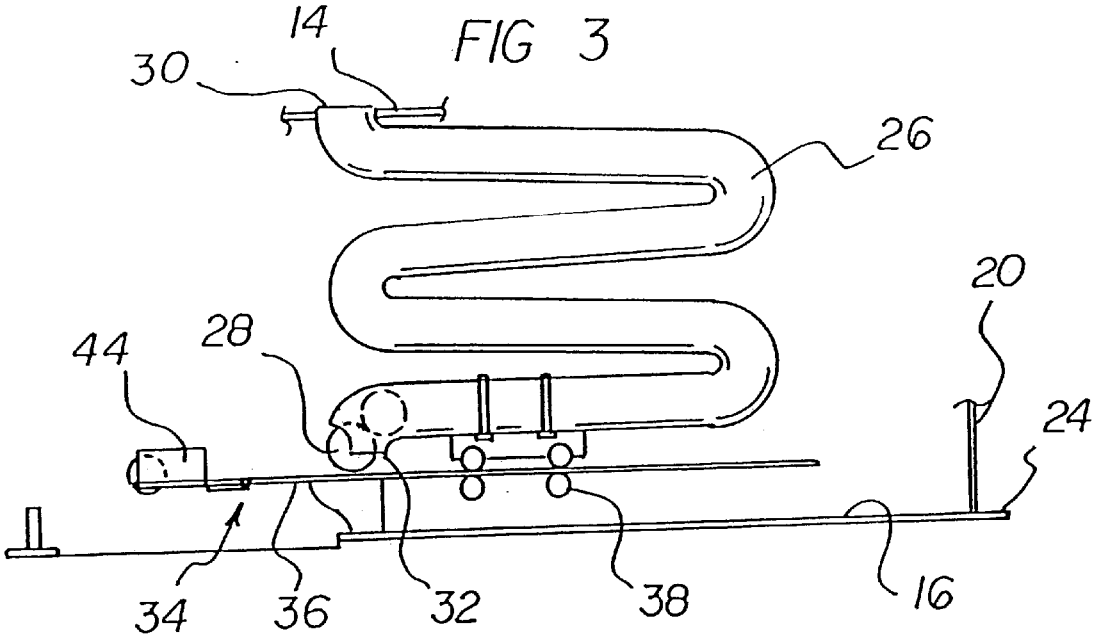
FIG. 3 is a cross-sectional view of the present invention as taken along line 3—3 of FIG. 1.
Figure 4:
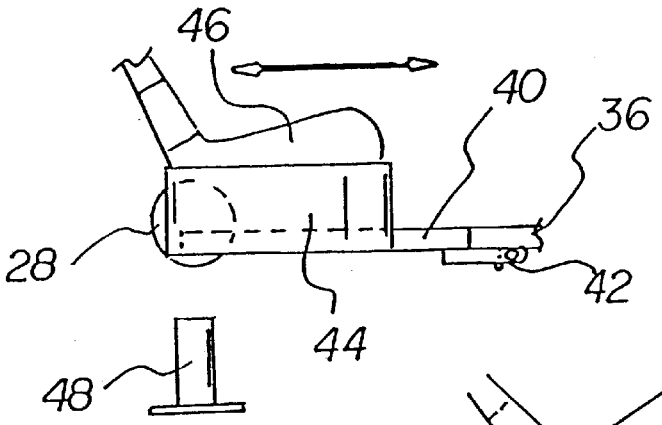
FIG. 4 is a sectional side view of the present invention illustrated in use.
Figure 5:
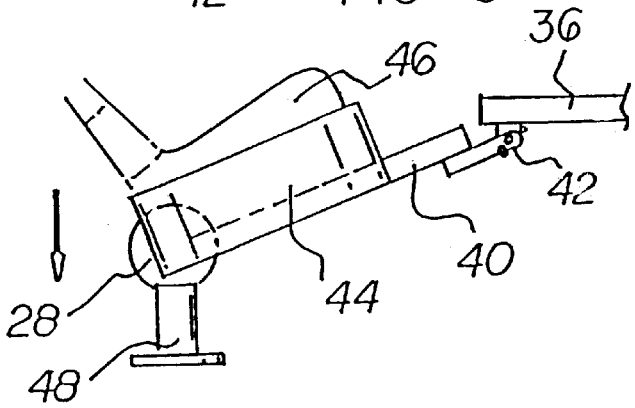
FIG. 5 is a sectional side view of the present invention illustrated in use.

With reference now to the drawings, and in particular, to FIGS. 1 through 5 thereof, the preferred embodiment of the new and improved golf ball teeing apparatus embodying the principles and concepts of the present invention and generally designated by the reference number 10 will be described.

Specifically, it will be noted in the various Figures that the device relates to a golf ball teeing apparatus for placing a golf ball on a tee without requiring bending over by a golfer. In its broadest context, the device consists of a housing, a tubular golf ball casing, a slide assembly, a circular member, and a tee. Such components are individually configured and correlated with respect to each other so as to attain the desired objective.

The housing 12 has a generally rectangular configuration. The housing 12 is defined by a top wall 14, a bottom wall 16, opposed long side walls 18, and opposed short end walls 20. The top wall 14 has an opening 22 therethrough exposing a hollow interior of the housing 12. The bottom wall 16 has a peripheral flange 24 secured thereto. The housing 12 has an outlet 25 through a corner formed by one of the opposed long side walls 18 and an adjacent end wall 20.

The tubular golf ball casing 26 is disposed within the hollow interior of the housing 12 for receiving a plurality of golf balls 28 therein. The golf ball casing 26 has a serpentine configuration defined by an open upper end 30 disposed within the opening 22 in the top wall 14 of the housing 12. The golf ball casing 26 has an open lower end 32 disposed adjacent the outlet 25 of the housing 12.

The slide assembly 36 is slidably disposed within the hollow interior of the housing 12. The slide assembly 36 includes a pair of sliding tracks 36 disposed below the open lower end 32 of the golf ball casing 26. The pair of tracks 36 are dimensioned for receiving a golf ball 28 therebetween. The pair of tracks 36 are positioned between upper and lower sets of rollers 38 to facilitate sliding of the pair of tracks 36 outwardly of the outlet 25 of the housing 12. The pair of tracks 36 include an outer section 40 hingedly secured to outer ends thereof. A pair of springs 42 extend between the outer section 40 and the pair of tracks 36 whereby the springs 42 bias the outer section 40 into a collinear relationship with the pair of tracks 36. Note FIG. 4.

The circular member 44 is secured to an outer surface of the outer section 40 of the pair of tracks 36 of the slide assembly 36. The circular member 44 is dimensioned for receiving a head of a golf club 46 therein to facilitate pivoting of the outer section 40 with respect to the pair of tracks 36. Note FIG. 5.

The tee 48 is positioned adjacent to the outer section 40 of the pair of tracks 36 of the slide assembly 36 when the pair of tracks 36 are fully extended outwardly of the housing 12. The tee 48 receives a golf ball 28 thereon. The head of the golf club 46 is placed within the circular member 44 and pressed downwardly thereby causing the outer portion 40 to angle downwardly to allow for the golf ball 28 to drop onto the tee 48. The pair of tracks 36 would then be slid back into the housing 12 away from the tee 48 to allow for the golf ball 28 to be struck.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A golf ball teeing apparatus for placing a golf ball on a tee without requiring bending over by a golfer comprising, in combination:

a housing having a generally rectangular configuration, the housing being defined by a top wall, a bottom wall, opposed long side walls, and opposed short end walls, the top wall having an opening therethrough exposing a hollow interior of the housing, the bottom wall having a peripheral flange secured thereto, the housing having an outlet through a corner formed by one of the opposed long side walls and an adjacent end wall;

a tubular golf ball casing disposed within the hollow interior of the housing for receiving a plurality of golf balls therein, the golf ball casing having a serpentine configuration defined by an open upper end disposed within the opening in the top wall of the housing, the golf ball casing having an open lower end disposed adjacent the outlet of the housing;

a slide assembly slidably disposed within the hollow interior of the housing, the slide assembly including a pair of sliding tracks disposed below the open lower end of the golf ball casing, the pair of tracks being dimensioned for receiving a golf ball therebetween, the pair of tracks being positioned between upper and lower sets of rollers to facilitate sliding of the pair of tracks outwardly of the outlet of the housing, the pair of tracks including an outer section hingedly secured to outer ends thereof, apair of springs extending between the outer section and the pair of tracks whereby the springs bias the outer section into a collinear relationship with the pair of tracks;

a circular member secured to an outer surface of the outer section of the pair of tracks of the slide assembly, the circular member being dimensioned for receiving a head of a golf club therein to facilitate pivoting of the outer section with respect to the pair of tracks;

a tee positioned adjacent to the outer section of the pair of tracks of the slide assembly when the pair of tracks are fully extended outwardly of the housing, the tee receiving a golf ball thereon.

2. A golf ball teeing apparatus for placing a golf ball on a tee without requiring bending over by a golfer comprising, in combination:

a housing having a generally rectangular configuration, the housing being defined by a top wall, a bottom wall, opposed long side walls, and opposed short end walls, the top wall having an opening therethrough exposing a hollow interior of the housing, the bottom wall having a peripheral flange secured thereto, the housing having an outlet through a corner formed by one of the opposed long side walls and an adjacent end wall;

a tubular golf ball casing disposed within the hollow interior of the housing for receiving a plurality of golf balls therein, the golf ball casing having a serpentine configuration defined by an open upper end disposed within the opening in the top wall of the housing, the golf ball casing having an open lower end disposed adjacent the outlet of the housing;

a slide assembly slidably disposed within the hollow interior of the housing below the open lower end of the golf ball casing whereby the slide assembly transports the golf balls outwardly of the outlet of the housing, said slide assembly includes a pair of sliding tracks disposed below the open lower end of the golf ball casing, the pair of tracks being dimensioned for receiving a golf ball therebetween, the pair of tracks being positioned between upper and lower sets of rollers to facilitate sliding of the pair of tracks outwardly of the outlet of the housing.

3. The golf ball teeing apparatus as set forth in claim 2 wherein the pair of tracks include an outer section hingedly secured to outer ends thereof, a pair of springs extending between the outer section and the pair of tracks whereby the springs bias the outer section into a collinear relationship with the pair of tracks.

4. The golf ball teeing apparatus as set forth in claim 3 and further including a circular member secured to an outer surface of the outer section of the pair of tracks of the slide assembly, the circular member being dimensioned for receiving a head of a golf club therein to facilitate pivoting of the outer section with respect to the pair of tracks.

5. The golf ball teeing apparatus as set forth in claim 3 and further including a tee positioned adjacent to the outer section of the pair of tracks of the slide assembly when the pair of tracks are fully extended outwardly of the housing, the tee receiving a golf ball thereon.

* * * * *